US005904161A

United States Patent [19]

Rai et al.

[11] Patent Number: 5,904,161

[45] Date of Patent: May 18, 1999

[54] CLEANING COMPOSITIONS CONTAINING BLEACH AND STABILITY-ENHANCED ENZYMES

[75] Inventors: Saroj Rai, West Chester; William Michael Scheper, Fairfield; Lucille Florence Taylor, Middletown; Gregory Stephen Caravajal, Fairfield; James Charles Theophile Roger Burckett-St. Laurent, Cincinnati; Kakumanu Pramod, West Chester, all of Ohio

[73] Assignee: The Procter & Gamble Company, Cincinnati, Ohio

[21] Appl. No.: 08/608,210

[22] Filed: Feb. 28, 1996

Related U.S. Application Data

[63] Continuation of application No. 08/249,581, May 25, 1994.

[51] Int. Cl.[6] ..... C11D 3/386; C11D 3/395; C11D 3/26; B08B 9/20

[52] U.S. Cl. ..... 134/25.2; 510/226; 510/229; 510/234; 510/224; 510/374; 510/376; 510/392; 510/504

[58] Field of Search ..... 510/226, 229, 510/232, 224, 374, 376, 392, 504; 134/25.2

[56] References Cited

U.S. PATENT DOCUMENTS

| | | | |
|---|---|---|---|
| 4,539,130 | 9/1985 | Thompson et al. | 252/94 |
| 4,568,476 | 2/1986 | Kielman et al. | 252/95 |
| 4,597,886 | 7/1986 | Goedhart et al. | 252/85 |
| 4,620,936 | 11/1986 | Kielman et al. | 252/99 |
| 4,818,426 | 4/1989 | Humphreys et al. | 252/99 |
| 4,904,406 | 2/1990 | Darwen et al. | 252/102 |
| 5,093,022 | 3/1992 | Sotoya et al. | 252/102 |
| 5,238,132 | 8/1993 | Kamel et al. | 252/94 |
| 5,240,633 | 8/1993 | Ahmed et al. | 252/99 |
| 5,246,612 | 9/1993 | Van Dijk et al. | 525/102 |
| 5,292,446 | 3/1994 | Painter et al. | 252/99 |
| 5,405,412 | 4/1995 | Willey et al. | 8/111 |
| 5,503,639 | 4/1996 | Willey et al. | 8/111 |

FOREIGN PATENT DOCUMENTS

| | | | |
|---|---|---|---|
| 508623 | 10/1992 | European Pat. Off. . | |
| 0512533 | 11/1993 | European Pat. Off. . | |
| 1198700 | 8/1988 | Japan . | |
| 9100353 | 1/1991 | WIPO . | |
| 94/02597 | 2/1994 | WIPO | C12N 9/28 |
| 9402597 | 3/1994 | WIPO . | |
| 9418314 | 8/1994 | WIPO . | |

OTHER PUBLICATIONS

Estell, "Engineering an Enzyme by Site—directed Mutagenesis to be Resistent to Chemical Oxidation", *The Journal of Biological Chemistry,* vol. 260 No. 11 pp. 6518–6521 (1985).

*Primary Examiner*—Kery Fries
*Attorney, Agent, or Firm*—Brian M. Bolam; Kim William Zerby; Jacobus C. Rasser

[57] ABSTRACT

Cleaning compositions, particularly automatic dishwashing detergent compositions, comprising a stability-enhanced amylase and bleach-improving materials are provided. More specifically, the invention relates to granular automatic dishwashing detergents which provide enhanced cleaning/bleaching benefits. The automatic dishwashing compositions comprise stability-enhanced amylase enzymes and one or more bleach-improving compounds, such as organic peroxides, quaternary substituted bleach activators, quaternary substituted peracids and manganese or iron bleach catalysts.

7 Claims, No Drawings

CLEANING COMPOSITIONS CONTAINING BLEACH AND STABILITY-ENHANCED ENZYMES

This is a continuation of application Ser. No. 08/249,581, filed on May 25, 1994.

TECHNICAL FIELD

The present invention is in the field of cleaning compositions comprising enzymes and bleaching materials, particularly automatic dishwashing detergents. More specifically, the invention encompasses granular automatic dishwashing detergents which provide enhanced cleaning/bleaching benefits. These compositions comprise stability-enhanced amylase enzymes and one or more bleach-improving compounds.

BACKGROUND OF THE INVENTION

Automatic dishwashing, particularly automatic dishwashing in domestic appliances, is an art having important distinguishing features from superficially similar arts such as fabric laundering and institutional dishcare. For example, domestic fabric laundering is normally done in purpose-built machines having a tumbling action, quite distinct from spray-action domestic automatic dishwashing appliances. In domestic machine dishwashing, dishes need to be rendered clean, that is to say, for all practical purposes, to "have the soil completely removed". Decolorization of the soil, as in fabric bleaching, will not suffice. It is not clear that such cleaning action actually requires "bleaching" in the traditional laundry sense at all; on the other hand, some bleaching chemicals can, in certain circumstances, be desirable for cleaning dishware.

In contrast to typical institutional tableware, consumer glasses, dishware and flatware, especially decorative pieces, as washed in domestic automatic dishwashing appliances, are often susceptible to damage and can be expensive to replace. Typically, consumers dislike having to separate finer pieces and the obligation of washing these by hand and would prefer the convenience and simplicity of being able to lump all their tableware and cooking utensils into a single, automatic washing operation. Yet doing this as a matter of routine has not yet been achieved.

Because of these consumer demands and needs, ADD compositions are undergoing continual change and improvement. Additionally, environmental factors such as the desirability of providing ever-better cleaning results with less product, providing less thermal energy, and less water to assist the washing process, have driven the need for improved ADD compositions.

A recognized need in ADD compositions is to have present one or more ingredients which improve the removal of starchy food residues or starchy films from dishware, flatware, and glasses. Other than use of large quantities of water, heat, and time, the simplest approach to achieve this function is to use sodium hydroxide. However, strong alkalis like sodium hydroxide are potentially hazardous in a domestic setting and even can be damaging to, or leave a film upon, glasses or dishware. Accordingly, milder ADD compositions have been developed which typically incorporate amyolytic enzymes such as TERMAMYL® available from Novo Nordisk S/A. The alpha-amylase component provides at least some benefit in the starchy soil removal properties of the ADD. ADD's containing amylases typically can deliver a somewhat more moderate wash pH in use and can avoid delivering large weight equivalents of sodium hydroxide on a per-gram-of-product basis. However, often the amylases used in ADD compositions are those developed for use in quite different fields, such as fabric washing, textile desizing or even starch liquefaction and are not as effective as might be desired when used in dishwashing. There remains a substantial technical challenge in co-formulating essential ADD components such as amylase-compatible bleaches, sequestrants and surfactants in such a manner as to meet the consumer's need for superior cleaning performance at an excellent value in a safe, environmentally acceptable product which leaves the dishware, glasses and flatware in fine and undamaged condition. A need therefore exists for the development of amylase enzymes specifically designed to be compatible in ADD formulations.

Accordingly, manufacturers of enzyme preparations have lately been developing novel alpha-amylases, which at least in some tests, exhibit a greater or lesser degree of one or more technically measurable improvements. Examples of such improvements include providing new amylases which are more thermally stable, have a better temperature optimum for cold-fill, warm wash or warm-fill appliances, have a pH optimum better aligned with those now preferred for ADD's, or have a greater hydrolysis velocity for starches than the hydrolysis velocity exhibited by conventional alpha-amylases.

More particularly, and without being limited by theory, the currently commercial varieties of alpha-amylases, including those having improved bleach stability in certain tests, can exhibit an unpredictable range of stability and compatibility with the huge array of different possible bleaching or stain removing agents ranging from chlorinated isocyanurates, peroxidases and phthalocyanines, persulfates, perborates and di-organo peroxides, through to many hundreds of different types of bleach catalysts or "accelerators", preformed organic peracids and thousands of possible bleach activator chemicals. This is particularly true in fully-formulated detergent products. Despite ongoing and continuous research the richly varied array of bleach or stain-removal chemistry has not been reduced to a simple governing mechanism. In bleach chemistry, including the aspect of undesirable potential attack on enzymes as well as the desirable aspect of bleaching/cleaning soils, there are often many reaction steps to be considered.

In view of the foregoing considerations, it is apparent that there remains in the industry a need for improved ADD compositions, which on one hand contain amyolytic enzymes and on the other, compatibly provide stain removal or sanitizing technology, such as that derivable from certain bleaches. It is an object of the instant invention to provide such compositions without, since such stability advantages are limited, relying exclusively on bleach stability advantages of the new amylases.

In another aspect of the invention, it is an object herein to provide fully-formulated ADD compositions wherein the bleach/amylase combinations are combined with additional selected ingredients so as to deliver superior cleaning results at the same time as excellent dishcare.

BACKGROUND ART

WO/94/02597, Novo Nordisk A/S, published Feb. 3, 1994, describes cleaning compositions, including dishwashing compositions, which incorporate mutant amylases.

SUMMARY OF THE INVENTION

It has now surprisingly been discovered that a specific group of improved amylases, recently developed by conventional genetic engineering techniques, in combination with a newly discovered, selected group of bleach systems, provide unexpected superior automatic dishwashing detergent, ADD, cleaning performance. Such performance is illustrated by, but not limited to, excellent starchy soil removal and tea stain removal. Unexpectedly, performance benefits are observed for these compositions in areas such as removal of complex food soils which have proteinaceous components; and these compositions are less damaging to consumer tableware than might be expected on the basis of their potent bleaching action.

Also advantageously, in view of potential negative environmental impact, the bleach component of this invention is not reliant on chlorinated compounds and avoids the undesirable use of overly high levels of caustic ingredients. Moreover the ADD compositions offered by the instant invention have attractive economic advantages.

Novel ADD compositions are even provided herein which are unreliant on the perborates. The latter are common commercial bleaching agents which contain not only bleaching oxygen but also inherently deliver hydrogen peroxide moderating effects via thier complexing tendencies, as well as enzyme-buffering and enzyme-stabilizing by virtue of their borate component. The desirability of low or zero borate products is recognized, particularly in geographies wherein boron is already present at appreciable levels in the natural environment, such as the State of California.

The present invention encompasses cleaning compositions, particularly, automatic dishwashing detergent compositions, comprising:

a) a catalytically effective amount of a stability-enhanced amylase enzyme, said stability-enhancement being relative to the parent/non-mutant form of said amylase enzyme;

b) an effective amount of an oxygen bleach system, said oxygen bleach system comprising one or more bleach-improving materials selected from the group consisting of:

i) organic peroxides, especially diacyl peroxides;
ii) quaternary substituted bleach activators;
iii) quaternary substituted peracids;
iv) transition-metal bleach catalysts;
v) peroxidase enzymes; and
vi) mixtures thereof The preferred cleaning compositions of this invention are substantially free of chlorine bleach. By "substantially free of chlorine bleach" is meant that the formulator does not add a chlorine-containing bleach additive, such as a chloroisocyanurate, to the preferred detergent composition. However, it is recognized that because of factors outside the control of the formulator, such as chlorination of the water supply, some non-zero amount of chlorine bleach may be present in the wash liquor.

The stability-enhanced amylases of this invention are preferably oxidative stability-enhanced.

By "effective amount" is meant an amount which is sufficient, under whatever comparative test conditions are employed, to enhance cleaning of the target substrate. Likewise, the term "catalytically effective amount" refers to an amount which is sufficient under whatever comparative test conditions are employed, to enhance cleaning of the target substrate. Thus, in a fabric laundering operation, the target substrate will typically be a fabric stained with, for example, various food stains. For automatic dishwashing, the target substrate may be, for example, a porcelain cup with tea stain, dishes soiled with simple starches or more complex food soils, or a polyethylene plate stained with tomato soup. The test conditions will vary, depending on the type of washing appliance used and the habits of the user. Thus, front-loading laundry washing machines of the type employed in Europe generally use less water and higher detergent concentrations than do top-loading U.S.-style machines. Some machines have considerably longer wash cycles than others. Some users elect to use very hot water; others use warm or even cold water in fabric laundering operations. Of course, the performance of the enzymes will be affected by such considerations, and the levels used in fully-formulated detergent and cleaning compositions can be appropriately adjusted.

In preferred embodiments, the cleaning compositions of this invention comprise an oxygen bleach system comprising from about 0.5% to about 5%, expressed on an available oxygen basis which is equivalent to from about 3.3% to about 33%, by weight of composition, of a hydrogen peroxide source preferably selected from the group consisting of percarbonate, perborate, and mixtures thereof; from about 0.1% to about 10%, preferably from about 2% to about 7%, by weight of composition, of a bleach-improving material selected from the group consisting of organic peroxides (preferably diacyl peroxides), quaternary substituted bleach activators and mixtures thereof; and from 0% to about 1%, preferably from about 0.001% to about 0.7%, more preferably from about 0.01% to about 0.1%, by weight of composition, of a transition-metal bleach catalyst. Optionally, the bleach-improving materials may be supplemented by TAED, NOBS, or other nonquaternary bleach activators.

For automatic dishwashing detergent compositions of this invention preferred compositions comprise: from about 0.5% to about 5%, preferably from about 1% to about 3% by weight of composition, of an oxidative stability enhanced amylase (such amylase is typically from about 1% to about 4% active protein); and from about 2% to about 20%, by weight of composition, of bleach-improving materials selected from the group consisting of dibenzoyl peroxides, quaternary substituted bleach activators, quaternary substituted peracids, manganese or iron bleach catalysts, and mixtures thereof.

Preferred automatic dishwashing compositions of this invention further comprise from about 0.1% to about 10% of a low foaming surfactant. In preferred embodiments, the cleaning compositions of this invention are preferably substantially free of anionic surfactant. By "substantially free of anionic surfactant" is meant that the preferred composition would comprise less than 2% anionic surfactant.

Preferred automatic dishwashing compositions further comprise from about 1% to about 50%, by weight of composition, of pH adjusting component to provide a wash solution pH of at least about 8.

Preferred automatic dishwashing composition are in granular form and comprise from about 0.1% to about 5% quaternary substituted bleach activator or quaternary substituted peracid. For granulation, the melting-point of said quaternary substituted materials is preferably at least 30° C.

A particularly preferred granular or powdered automatic dishwashing detergent composition comprises:

(a) from about 0.5% to about 5%, by weight of composition, of an oxidative stability-enhanced amylase;

(b) from about 1% to about 5% (on an available oxygen basis) of a hydrogen peroxide source selected from the group consisting of percarbonate, perborate and mixtures thereof;

(c) from about 0.1% to about 10%, more preferably from about 1% to about 5%, of bleach-improving material selected from the group consisting of dibenzoyl peroxides, quaternary substituted bleach activators, quaternary substituted peracids, manganese or iron bleach catalysts, and mixtures thereof, optionally supplemented by nonquaternary bleach activators such as tetraacetylethylenediamine or nonanoyloxybenzenesulfonate;

(d) from about 1% to about 50% of a pH adjusting component, said component providing an initial wash solution pH from about 9.5 to about 11;

(e) from about 0.1% to about 10% of a low-foaming nonionic surfactant;

(f) from 0% to about 10% of a silicone suds suppressor; and (g) from 0% to about 25%, more preferably from about 1% to about 8%, of a dispersant polymer. In preferred embodiments, said composition has a molar ratio of hydrogen peroxide (as provided for by the hydrogen peroxide source) to bleach-improving material of from about 10:1 to about 1:1.

While bleach-improving materials and stability-enhanced amylases are the essential ingredients to the present invention, there are also provided embodiments wherein additional components, such as particular 2-ratio hydrous sodium silicates (such as Britesil H20™) are desirably present as part of the pH-adjusting component. Such silicates may be admixed with moderate levels, e.g., up to about 5%, by weight of the composition, of sodium metasilicate pentahydrate. Highly preferred embodiments of the invention are substantially free from phosphate salts and have low (e.g., from about 3% to about 17%, more preferably from about 3% to about 8% $SiO_2$) total silicate content. Additional components which can be added but are not not enumerated in (a)–(g) include but are not limited to transition-metal selective sequestrants, anticorrosives (especially for silver), perfumes, certain coatings and stabilizing agents, and mixtures thereof.

The present invention also encompasses a method for cleaning soiled tableware comprising contacting said tableware with an aqueous medium having an alkaline pH, preferably above about 8, more preferably from about 9.5 to about 11 and comprising at least about 500 ppm, preferably from about 1,000 ppm to about 5,000 ppm, more preferably from about 2000 ppm to about 4000 ppm, (i.e., about 0.4% in water) of a composition comprising the stability-enhanced amylases and bleach-improving materials.

The present invention further encompasses a cleaning composition comprising a catalytically effective amount of a stability-enhanced amylase enzyme, said stability-enhancement being relative to the parent/non-mutant form of said amylase enzyme, together with a catalytically effective amount of a protease enzyme and an oxygen bleach system, preferably comprising at least one quaternary-substituted bleach activator. Moreover, said cleaning composition is preferably in the form of a liquid or granular textile cleaning composition additionally comprising a transition-metal chelant and a nonionic surfactant.

Additionally secured are methods for compatibly combining the bleach and enzyme ingredients.

All parts, percentages and ratios used herein are expressed as percent weight unless otherwise specified. All documents cited are, in relevant part, incorporated herein by reference.

DETAILED DESCRIPTION OF THE INVENTION

Stability-Enhanced Amylase—Engineering of enzymes for improved stability, e.g., oxidative stability is known. See, for example J. Biological Chem., Vol. 260, No. 11, June 1985, pp 6518–6521.

"Reference amylase" hereinafter refers to an amylase outside the scope of the amylase component of this invention and against which stability of an amylase within the invention can be measured.

The present invention thus makes use of amylases having improved stability in detergents, especially improved oxidative stability. A convenient absolute stability reference-point against which amylases used in the instant invention represent a measurable improvement is the stability of TERMAMYL (R) in commercial use in 1993 and available from Novo Nordisk A/S. This TERMAMYL (R) amylase is a "reference amylase". Amylases within the spirit and scope of the present invention share the characteristic of being "stability-enhanced" amylases, characterized, at a minimun, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, all measured versus the above-identified reference-amylase. Preferred amylases herein can demonstrate further improvement versus more challenging reference amylases, the latter reference amylases being illustrated by any of the precursor amylases of which the amylases within the invention are variants. Such precursor amylases may themselves be natural or be the product of genetic engineering. Stability can be measured using any of the art-disclosed technical tests. See references disclosed in WO 94/02597, itself and documents therein referred to being incorporated by reference.

In general, stability-enhanced amylases respecting the invention can be obtained from Novo Nordisk A/S, or from Genencor International.

Preferred amylases herein have the commonality of being derived using site-directed mutagenesis from one or more of the Baccillus amylases, especialy the Bacillus alpha-amylases, regardless of whether one, two or multiple amylase strains are the immediate precursors.

As noted, "oxidative stability-enhanced" amylases are preferred for use herein. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B.licheniformis* alpha-amylase, known as TERMAMYL (R), or the homologous position variation of a similar parent amylase, such as *B. amyloliquefaciens, B.subtilis*, or *B.stearothermophilus;*

(b) Stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B.licheniformis* NCIB8061. Methionine (Met) was identified as the most likely residue to be modified. Met was substituted, one at a time, in positions 8,15,197,256,304,366 and 438 leading to specific mutants, particularly important being M197L and M197T with the M197T variant being the most stable expressed variant. Stability was measured in CASCADE (R) and SUNLIGHT (R);

(c) Particularly preferred herein are amylase variants having additional modification in the immediate parent available from Novo Nordisk A/S. These amylases do not yet have a tradename but are those referred to by the supplier as QL37+M197T.

Any other oxidative stability-enhanced amylase can be used, for example as derived by site-directed mutagenesis from known chimeric, hybrid or simple mutant parent forms of available amylases.

Oxygen Bleaching System—Cleaning Compositions according to the invention comprise an oxygen bleach system. The oxygen bleach system comprises one or more bleach-improving materials selected from the group consisting of i) organic peroxides (preferably diacyl peroxides);

ii) quaternary substituted bleach activators;

iii)quaternary substituted peracids;

iv) transition-metal bleach catalysts and v) mixtures thereof

Organic Peroxides, especially Diacyl Peroxides—are extensively illustrated in Kirk Othmer, Encyclopedia of Chernical Technology, Vol. 17, John Wiley and Sons, 1982 at pages 27–90 and especially at pages 63–72, all incorporated herein by reference. Suitable organic peroxides, especially diacyl peroxides, are further illustrated in "Initiators for Polymer Production", Akzo Chemicals Inc., Product Catalog, Bulletin No. 88-57. Also see U.S. Pat. Nos. 4,154,659 and 4,387,044, both incorporated herein by reference. Preferred diacyl peroxides herein whether in pure or formulated form constitute solids at 25° C., e.g., CADET BPO 78 powder form of dibenzoyl peroxide, from Akzo. Highly preferred organic peroxides, particularly the diacyl peroxides, herein have melting points above 40° C., preferably above 50° C. Additionally, preferred are the organic peroxides with SADT's (as defined in the foregoing Akzo publication) of 35° C. or higher, more preferably 70° C. or higher. Nonlimiting examples of diacyl peroxides useful herein include dibenzoyl peroxide, lauroyl peroxide, and dicumyl peroxide. Dibenzoyl peroxide is preferred. In some instances, diacyl peroxides are available in the trade which contain oily substances such as dioctyl phthalate. In general, it is preferred to use diacyl peroxides which are substantially free from oily phthalates since these can form smears on dishes and glassware.

Quaternary Substituted Bleach Activators—The present compositions desirably contain a quaternary substituted bleach activator (QSBA), especially when the composition is to be used for automatic dishwashing. QSBA's herein typically have the formula E—$[Z]_n$—C(O)—L wherein group E is referred to as the "head", group Z is referred to as the "spacer" (n is 0 or 1, i.e., this group may be present or absent, though its presence is generally preferred) and L is referred to as the "leaving group". These compounds generally contain at least one quaternary substituted nitrogen moiety, which can be contained in E, Z or L. More preferably, a single quaternary nitrogen is present and it is located in group E or group Z. In general, L is a leaving group, the pKa of the corresponding carbon acid (HL) of which can lie in the general range from about 5 to about 30, more preferably, from about 10 to about 20, depending upon the hydrophilicity of the QSBA. pKa's of leaving groups are further defined in U.S. Pat. No. 4,283,301.

Preferred QSBA's herein are, on one hand, water-soluble, but on the other hand, have a tendency to partition to a definite extent into surfactant micelles, especially into micelles of nonionic surfactants.

Leaving groups and solubilizing tendencies of quaternary moieties which can be present in the QSBA's are further illustrated in U.S. Pat. No. 4,539,130, Sep. 3, 1985 incorporated by reference. This patent also illustrates QSBA's in which the quaternary moiety is present in in the leaving group L.

British Pat. 1,382,594, published Feb. 5, 1975, discloses a class of QSBA's found suitable for use herein. In these compounds, Z is a poly(methylene) or oligo(methylene) moiety, i.e., the spacer is aliphatic, and the quaternary moiety is E. U.S. Pat. No. 4,818,426 issued Apr. 4, 1989 discloses another class of QSBA's suitable for use herein. These compounds are quaternary ammonium carbonate esters wherein, with reference to the above formula, the moiety Z is attached to E via a carbon atom but is attached to the carbonyl moiety through a linking oxygen atom. These compounds are thus quaternary ammonium carbonate esters. The homologous compounds wherein the linking oxygen atom is absent from Z are likewise known and are useful herein. See, for example, U.S. Pat. No. 5,093,022 issued Mar. 3, 1992 and U.S. Pat. No. 4,904,406, issued Feb. 27, 1990.

Additionally, QSBA's are described in EP 552,812 A1 published Jul. 28, 1993, and in EP 540,090 A2, published May 5, 1993. All of the foregoing documents are incorporated by reference.

Particularly preferred QSBA's have a caprolactam or valerolactam leaving group, and are the subject of copending applications, in particular co-pending commonly assigned British Patent Appl. Ser. No. 94,079,449, filed Apr. 21, 1994, P&G Case No. CM705F.

Preferred embodiments of QSBA's useful in the present invention can be synthesized as follows:

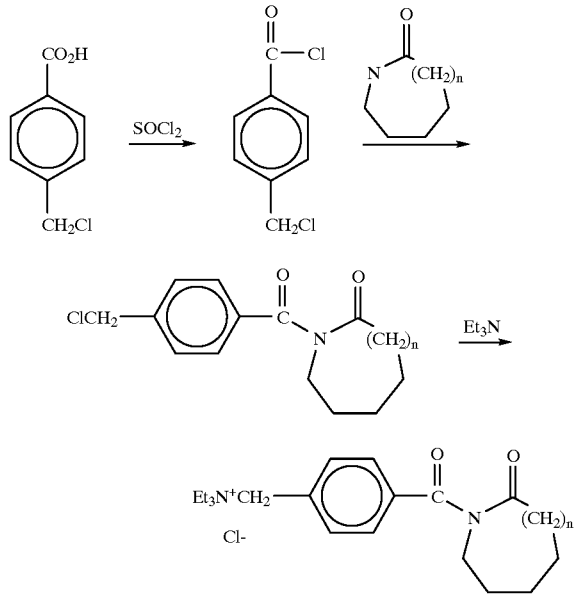

The following describes the synthesis in more detail.

PREPARATION OF N-[4-(TRIETHYLAMMONIOMETHYL)BENZOYL] CAPROLACTAM, CHLORIDE SALT 4-chloromethyl benzoyl acid chloride—A 1-neck round bottom flask is fitted with an addition funnel, gas inlet and magnetic stirring and charged with 4-chloromethyl benzoic acid (0.5 mol), toluene (1.0 mol acid/350 ml) and a boiling stone under Argon. Thionyl chloride (1.0 mol) is added dropwise via an addition funnel. A reflux condenser is substituted for the additional funnel and the reaction is heated to toluene reflux for 4 hours under Argon. The reaction is cooled to room temperature. The solvent is evaporated.

4-chloromethyl benzoyl caprolactam—A 3-neck round bottom flask is fitted with mechanical stirring, reflux condenser, addition funnel, and gas inlet and is charged with caprolactam (0.5 mol), triethylamine (0.75 mol) and 75% of the required toluene (1.0 mol caprolactam/1.5 liters) under Argon. The solution is heated to toluene reflux. 4-chloromethyl benzoyl acid chloride (0.5 mol) suspended in remaining toluene is added in a slow stream. The reaction is stirred under Argon at toluene reflux for 6 hours, cooled slightly and filtered. The collected solids, triethylamine hydrochloride, is discarded and the filtrate is reffigerated to precipitate product. The product is collected by vacuum filtration, washed and dried.

N-[4-(triethylammoniomethyl)benzoyl] caprolactam, chloride salt—A 1-neck round bottom flask is fitted with magnetic stirring, addition funnel and gas inlet and is charged with 4-chloromethyl benzoyl caprolactam (0.5 mol) and acetonitrile (1 mole caprolactam/1.5 liters) under Argon. Triethylarnine (1.0 mol) is added dropwise. A reflux condenser is substituted for the addition funnel and the reaction is heated to acetonitrile reflux for 4 hours under Argon. The reaction is cooled to room temperature and solvent is evaporated. Excess acetone is added to the flask with magnetic stirring to break apart the product. The mixture is heated to acetone reflux briefly then cooled to room temperature. The product is vacuum filtered, washed and dried.

The above synthesis may be repeated, but with substitution of valerolactam for caprolactam. The synthesis may also be repeated with, for example, the substitution of trimethylamine for triethylamine. In each instance, the corresponding cationic bleach activator is secured.

While the foregoing QSBA's include preferred embodiments presented for the purposes of better illustating the invention, their specific recital should not be taken as limiting. Other QSBA's known in the art may be substituted. Examples include modifications of the above structures in which groups E or Z form part of a heterocyclic ring or modifications in which the leaving group L has a hydrolytically resistant covalent bond to either group E or group Z; in the latter instance, L is considered a "tethered" leaving group as in either of the structures:

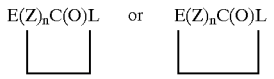

and upon perhydrolysis, still "leaves" the $E(Z)_nC(O)$ moiety and forms a peracid, such as one having either of the structures:

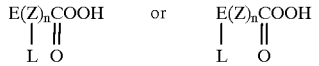

Moreover, in further examples of known QSBA's, leaving groups are not connected to the moiety $E(Z)_nC(O)$ via a neutral nitrogen atom, but rather, are connected via an oxygen atom as in the common leaving group OBS (oxybenzenesulfonate). Examples of such variations have been documented in the literature, including above-referenced patents.

Quaternary Substituted Peracids—Quaternary Substituted Peracids (QSP's) are also suitable for use in the instant compositions. QSP's generally conform to the QSBA structure with the exception that group L is replaced by a —OOH moiety. QSP's can be made in situ or preformed by perhydrolyzing the foregoing QSBA's. Specific QSP's of particular use herein are those of U.S. Pat. No. 5,245,075, issued Sep. 14, 1993. and in WO 94/01399 published Jan. 20, 1994. The background section of the latter PCT application contains disclosures of two additional QSP's which are useful herein. All the above documents describing components (ii) and (iii) are incorporated herein by reference.

To be noted, QSBA's and QSP's herein generally contain counter-anions to balance the positive charge derived from the quaternary nitrogen. Suitable counterions are chloride, methosulfate, borate, and any other convenient organic or inorganic anions provided that the QSP or QSBA remains soluble.

When required, QSBA's or QSP's can be stabilized in product by a number of means, principal of which are the application of bleach-resistant coatings, such as can be provided by bleach-resistant waxy nonionic surfactants; or by selecting QSBA or QSP structures which contain one or more benzene rings so as to increase the melting-point at least above 30° C. and preferably above 50° C., thereby preventing migration of the QSBA or QSP into the remainer of the composition. Alternatively, or in addition to the foregoing stabilizing approaches; hydrogen peroxide sources, such as sodium percarbonate, can be segregated from the QSBA or QSP by means of organically impermeable silicate or borosilicate coatings.

In general, it should be recognized that QSBA's or QSP's collectively can, in aqueous solution, provide both formally cationic species, such as $(CH_3)_3N^+CH_2C(O)OOH$ and formally zwitterionic species such as $(CH_3)_3N^+CH_2C(O)OO^-$. Regardless of whether formally cationic or zwitterionic materials are generated, they remain within the scope of the present invention provided that at least one quaternary nitrogen is present. Again, depending on the precise modification, there may be a plurality of charged sites, requiring that in the solid, salt form, a balancing number of anions which can vary widely provided that they do not render the QSBA or QSP substantially insoluble.

Transition Metal Bleach Catalysts—Transition metal bleach catalysts herein can range from supported or unsupported transition metal salts, including but not limited to those of iron, manganese, copper, cobalt and ruthenium; see for example U.S. Pat. No. 3,398,096 issued Aug. 20, 1968, including simple water-soluble salts of iron and manganese such as the divalent, trivalent, tetravalent and quadrivalent salts; to more sophisticated catalysts such as those of the following references:

One group of preferred catalysts are those comprising manganese. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544, 440A2, and 544,490A1; Preferred examples of these catalysts include $Mn^{IV}{}_2(u\text{-}O)_3$(1,4,7-trimethyl-1,4,7-triazacyclononane)$_2(PF_6)_2$, $Mn^{III}{}_2(u\text{-}O)_1(u\text{-}OAc)_2$ (1,4,7-trimethyl1,4,7-triazacyclononane)$_2$-$(ClO_4)_2$, $Mn^{IV}{}_4(u\text{-}O)_6$ (1,4,7-triazacyclononane)$_4$ $(ClO_4)_4$, $Mn^{III}Mn^{IV}{}_4(u\text{-}O)_1(u\text{-}OAc)_2$-(1,4,7-trimethyl-1,4,7-triazacyclono-nane)$_2$ $(ClO_4)_3$, $Mn^{IV}$(1,4,7-trimethyl-1,4,7-triazacyclononane)-$(OCH_3)_3$ $(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; and 5,227,084.

Iron or Manganese salts of aminocarboxylic acids in general are useful herein; these include iron and manganese aminocarboxylate salts disclosed for bleaching in the photographic color-processing arts. A particularly useful transition metal salt herein is derived from ethylenediaminedisuccinate, and any complex of this ligand with iron or manganese can be used. One such catalytic system is described in copending commonly assigned U.S. application Ser. No. 08/210,186, filed Mar. 17, 1994.

The bleach catalysts useful in machine dishwashing compositions and concentrated powder detergent compositions may also be selected as appropriate for the present invention. For examples of suitable bleach catalysts see U.S. Pat. No. 4,246,612 and U.S. Pat. No. 5,227,084.

See also U.S. Pat. No. 5,194,416 which teaches mononuclear manganese (IV) complexes such as $Mn^{IV}$(1,4,7-trimethyl-1,4,7-triazacyclononane)-$(OCH_3)_3(PF_6)$.

Still another type of bleach catalyst, as disclosed in U.S. Pat. No. 5,114,606, is a water-soluble complex of manganese (II), (III), and/or (IV) with a ligand which is a non-carboxylate polyhydroxy compound having at least three consecutive C-OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand.

Other examples include Mn gluconate, $Mn(CF_3SO_3)_2$, $Co(NH_3)_5Cl$, and the binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2](ClO_4)_3$.

The bleach catalysts of the present invention may also be prepared by combining a water-soluble ligand with a water-soluble transition metal salt such as one of manganese in aqueous media and concentrating the resulting mixture by evaporation. Any convenient water-soluble salt of the transition metal can be used herein provided that the metal is one known to react with hydrogen peroxide. The (II), (III), (IV) and/or (V) oxidation states may be used. In some instances, sufficient manganese may be present in the wash liquor, but, in general, it is preferred to add Mn cations in the compositions to ensure its presence in catalytically-effective amounts.

Other bleach catalysts are described, for example, in European Pat. App. Pub. Nos. 408,131 (cobalt complex catalysts), 384,503, and 306,089 (metallo-porphyrin catalysts), U.S. Pat. No. 4,728,455 (manganese/multidentate ligand catalyst), U.S. Pat. No. 4,711,748 and European Pat. App. Pub. No. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866, 191 (transition metal-containing salts), U.S. Pat. No. 4,430, 243 (chelants with manganese cations and non-catalytic metal cations), and U.S. Pat. No. 4,728,455 (manganese gluconate catalysts).

Bleach Catalysts, when used in the present invention, are preferably segregated from the hydrogen peroxide source, or from QSBA's, QSP's or diacyl peroxides. A convenient approach, which can have the additional advantage of conferring a protective effect upon enzymes as used herein, is to process the enzymes with a coating of transition metal bleach catalyst, optionally with a waxy nonionic surfactant.

In another mode, transition-metal containing bleach catalysts can be prepared in situ by the reaction of a transition-metal salt with a suitable chelating agent. For example, a mixture of manganese sulfate and EDDS (See Chelating Agent disclosure hereinafter).

When highly colored, transition metal-containing bleach catalysts may be oprocessed with zeolites, such as zeolite A or zeolite P, so as to reduce the color impact and improve the aesthetics of the product.

As a practical matter, and not by way of limitation, the compositions and processes herein can be adjusted to provide on the order of at least one part per ten million of the active bleach catalyst species in the aqueous washing medium, and will preferably provide from about 0.1 ppm to about 700 ppm, more preferably from about 1 ppm to about 500 ppm, of the catalyst species in the wash liquor.

Hydrogen Peroxide Source—In addition, the bleach system will generally contain a hydrogen peroxide source, as further defined hereinafter, whenever the bleach improving material or materials selected do not themselves contain a source of bleaching oxygen. That is, when the bleach improving material (b), as defined in the SUMMARY OF THE INVENTION section, comprises only component (ii), (iv) or (ii)+(iv), then a hydrogen peroxide source must be added to complete a minimum bleach system in accordance with the invention. On the other hand, when the bleach improving material is selected from components (i), (iii), (v), and mixtures thereof, it is not essential to add a hydrogen peroxide source.

In many preferred embodiments of the invention, a hydrogen peroxide source is provided regardless of whether the bleach improving material provides bleaching oxygen. The hydrogen peroxide source is typically hydrogen peroxide itself, or a compound which delivers hydrogen peroxide on dissolution, such as is the case with sodium perborate monohydrate, sodium perborate tetrahydrate, sodium percarbonate, or mixtures thereof. Coated forms of these solid hydrogen peroxide sources can be used.

Preferred hydrogen peroxide sources include sodium perborate, commercially available, e.g., in the form of mono- or tetra-hydrate; urea peroxyhydrate, sodium percarbonate, and sodium peroxide. Particularly preferred are sodium perborate, sodium perborate monohydrate and sodium percarbonate. Percarbonate is especially preferred because of environmental issues associated with boron. Many geographies are forcing legislation to eliminate elements such as boron from formulations.

Highly preferred percarbonate can be in uncoated or coated form. The average particle size of uncoated percarbonate ranges from about 400 to about 1200 microns, most preferably from about 400 to about 600 microns. If coated percarbonate is used, the preferred coating materials include carbonate, sulphate, silicate, borosilicate, and mixtures thereof. If any coating materials are used here or throughout the specification, such materials are preferably free of fatty carboxylic acid.

The mole ratio of hydrogen peroxide to bleach-improving material in the present invention preferably ranges from about 10:1 to about 1:1. Highly preferred ratios range from about 10:1 to about 3:1.

Optionally, conventional nonionic or anionic bleach activators having in common that they do not contain quaternary nitrogen (herein together with their corresponding peracids for convenience all collectively identified as "nonquaternary bleach activators"), such as TAED, NOBS (nonanoyloxybenzenesulfonate), benzoyl caprolactam, benzoyl valerolactam, or mixtures thereof can be added to the compositions. Other optional bleaching materials of this non-quaternary class include the heterocyclic peroxycarboxylic acids of U.S. Pat. No. 5,071,584; nonquaternary bleach activators and mixtures such as those of U.S. Pat. No. 5,269,962; surface-active peroxyacids such as those of U.S. Pat. No. 4,655,781; hydrophilic or hydrotropic peroxyacids such as those of U.S. Pat. No. 4,391,723; and older peroxybenzoic acid peracids or activator derivatives such as those of U.S. Pat. No. 3,075,921 or U.S. Pat. No. 2,955,905.

Protease Enzymes—Protease enzymes are usually present in preferred embodiments of the invention at levels sufficient to provide from 0.005 to 0.1 Anson units (AU) of activity per gram of composition. The proteolytic enzyme can be of animal, vegetable or microorganism (preferred) origin. More preferred is serine proteolytic enzyme of bacterial origin. Purified or nonpurified forms of enzyme may be used. Proteolytic enzymes produced by chemically or genetically modified mutants are included by definition, as are close structural enzyme variants. Particularly preferred by way of proteolytic enzyme is bacterial serine proteolytic enzyme obtained from Bacillus, *Bacillus subtilis* and/or *Bacillus licheniformis*. Suitable commercial proteolytic enzymes include Alcalase®, Esperase®, Durazym®, Savinase®, Maxatase®, Maxacal®, and Maxapem® 15 (protein engineered Maxacal); Purafect® and subtilisin BPN and BPN' are also commercially available. Preferred proteolytic enzymes also encompass modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme which is called "Protease A" herein. More preferred is what is called herein "Protease C", which is a triple variant of an alkaline serine protease from Bacillus in which tyrosine replaced valine at position 104, serine replaced asparagine at position 123, and alanine replaced threonine at position 274. Protease C is described in EP 90915958:4, corresponding to WO 91/06637, Published May 16, 1991, which is incorporated herein by reference. Genetically modified variants, particularly of Protease C, are also included herein. Some preferred proteolytic enzymes are selected from the group consisting of Savinase®, Esperase®, Maxacal®, Purafect®, BPN', Protease A and Protease B, and mixtures thereof. Bacterial serine protease enzymes obtained from *Bacillus subtilis* and/or *Bacillus licheniformis* are preferred. An especially preferred protease herein referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76 in combination with one or more amino acid residue positions equivalent to those selected from the group consisting of +99, +101, +103, +107 and +123 in *Bacillus amyloliquefaciens* subtilisin as described in the concurrently filed patent applications of A. Baeck, C. K. Ghosh, P. P. Greycar, R. R. Bott and L. J. Wilson, entitled "Protease-Containing Cleaning Compositions" having U.S. Ser. No. 08/136,797 (P&G Case 5040), and "Bleaching Compositions Comprising Protease Enzymes" having U.S. Ser. No. 08/136,626, which are incorporated herein by reference.

pH-Adjusting Component—preferred compositions herein comprise a pH-adjusting component selected from water-soluble alkaline inorganic salts and water-soluble organic or inorganic builders. The pH-adjusting components are selected so that when the ADD is dissolved in water at a concentration of 1,000–5,000 ppm, the pH remains in the range of above about 8, preferably from about 9.5 to about 11. The preferred nonphosphate pH-adjusting component of the invention is selected from the group consisting of:

(i) sodium carbonate or sesquicarbonate;

(ii) sodium silicate, preferably hydrous sodium silicate having $SiO_2$:$Na_2O$ ratio of from about 1:1 to about 2:1, and mixtures thereof with limited quantites of sodium metasilicate;

(iii) sodium citrate;

(iv) citric acid;

(v) sodium bicarbonate;

(vi) sodium borate, preferably borax;

(vii) sodium hydroxide; and (viii) mixtures of (i)–(vii).

Preferred embodiments contain low levels of silicate (i.e. from about 3% to about 8%$SiO_2$).

Illustrative of highly preferred pH-adjusting component systems are binary mixtures of granular sodium citrate with anhydrous sodium carbonate, and three-component mixtures of granular sodium citrate trihydrate, citric acid monohydrate and anhydrous sodium bicarbonate.

The amount of the pH adjusting component in the instant ADD compositions is preferably from about 1% to about 50%, by weight of the composition. In a preferred embodiment, the pH-adjusting component is present in the ADD composition in an amount from about 5% to about 40%, preferably from about 10% to about 30%, by weight.

For compositions herein having a pH between about 9.5 and about 11 of the initial wash solution, particularly preferred ADD embodiments comprise, by weight of ADD, from about 5% to about 40%, preferably from about 10% to about 30%, most preferably from about 15% to about 20%, of sodium citrate with from about 5% to about 30%, preferably from about 7% to 25%, most preferably from about 8% to about 20% sodium carbonate.

The essential pH-adjusting system can be complemented (i.e. for improved sequestration in hard water) by other optional detergency builder salts selected from nonphosphate detergency builders known in the art, which include the various water-soluble, alkali metal, ammonium or substituted ammonium borates, hydroxysulfonates, polyacetates, and polycarboxylates. Preferred are the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid; nitrilotriacetic acid, tartrate monosuccinic acid, tartrate disuccinic acid, oxydisuccinic acid, carboxymethyloxysuccinic acid, mellitic acid, and sodium benzene polycarboxylate salts.

When present, sodium and potassium, especially sodium, silicates are preferred. A particularly preferred alkali metal silicate is a granular hydrous sodium silicate having a $SiO_2$:$Na_2O$ ratio of about 2.0 or about 2.4 available from PQ Corporation, named Britesil H20 and Britesil H24. Most preferred is a granular hydrous sodium silicate having a $SiO_2$:$Na_2O$ ratio of 2.0. While typical forms, i.e., powder and granular, of hydrous silicate particles are suitable, preferred silicate particles have a mean particle size between about 300 and about 900 microns with less than 40% smaller than 150 microns and less than 5% larger than 1700 microns. Particularly preferred is a silicate particle with a mean particle size between about 400 and about 700 microns with less than 20% smaller than 150 microns and less than 1% larger than 1700 microns.

Alternate silicate-containing materials which can be used in the pH-adjusting component include zeohites, such as zeolites A and P, including recently described assertedly "maximum aluminium" variants; or, more preferably, layer silicates such as SKS-6, a wide variety of such silicates are available from Hoechst Corp. or from PQ Corp. When used in the instant compositions for pH-adjusting, aluminium anticorrosion or surfactant-absorbing effects, the levels of any limited water-solubility silicates should not be such as to result in deposition on dishware.

Low-Foaming Nonionic Surfactant—ADD compositions of the present invention can comprise low foaming nonionic surfactants (LFNIs). LFNI can be present in amounts from 0 to about 10% by weight, preferably from about 0.25% to about 4%. LFNIs are most typically used in ADDs on account of the improved water-sheeting action (especially from glass) which they confer to the ADD product. They also encompass non-silicone, nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene reverse block polymers. The PO/EO/PO polymer-type surfactants are well-known to have foam suppressing or defoaming action, especially in relation to common food soil ingredients such as egg.

The invention encompasses preferred embodiments wherein LFNI is present, and wherein this component is solid at about 95° F. (35° C.), more preferably solid at about 77° F. (25° C.). For ease of manufacture, a preferred LFNI has a melting point between about 77° F. (25° C.) and about 140° F. (60° C.), more preferably between about 80° F. (26.6° C.) and 110° F. (43.3°C.).

In a preferred embodiment, the LFNI is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16-C20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. 4,223,163, issued Sep. 16, 1980, Builloty, incorporated herein by reference.

Highly preferred ADDs herein wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 80%, preferably from about 30% to about 70%, of the total LFNI.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in the instant ADDs. Certain of the block polymer surfactant compounds designated PLURONIC® and TETRONIC® by the BASF-Wyandotte Corp., Wyandotte, Mich., are suitable in ADD compositions of the invention.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

Suitable for use as LFNI in the ADD compositions are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs which may also be used include a $C_{18}$ alcohol polyethoxylate, having a degree of ethoxylation of about 8, commercially available as SLF18 from Olin Corp., and any biodegradable LFNI having the melting point properties discussed hereinabove.

Preferred compositions of the present invention can optionally comprise limited quantities (up to about 2%) of nitrogen-containing nonionic surfactants, such as alkyldimethyl amineoxides or fatty glucosamides; when present, such surfactants normally require suds suppression e.g., by silicone suds suppressors.

Anionic Co-surfactant—The automatic dishwashing detergent compositions herein are preferably substantially free from anionic co-surfactants. It has been discovered that certain anionic co-surfactants, particularly fatty carboxylic acids, can cause unsightly films on dishware. Moreover, may anionic surfactants are high foaming. Without intending to be limited by theory, it is believed that such anionic co-surfactants can interact with the quaternary substituted bleach activator and reduce its performance. If present, the anionic co-surfactant is typically of a type having good solubility in the presence of calcium. Such anionic co-surfactants are further illustrated by sulfobetaines, alkyl (polyethoxy)sulfates (AES), alkyl (polyethoxy) carboxylates, and short chained $C_6$–$C_{10}$ alkyl sulfates.

Silicone and Phosphate Ester Suds Suppressors—The ADD's of the invention can optionally contain an alkyl phosphate ester suds suppressor, a silicone suds suppressor, or combinations thereof Levels in general are from 0% to about 10%, preferably, from about 0.001% to about 5%. Typical levels tend to be low, e.g., from about 0.01% to about 3% when a silicone suds suppressor is used. Preferred non-phosphate compositions omit the phosphate ester component entirely.

Silicone suds suppressor technology and other defoaming agents useful herein are extensively documented in "Defoaming, Theory and Industrial Applications", Ed., P. R.

Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

Levels of the suds suppressor depend to some extent on the sudsing tendency of the composition, for example, an ADD for use at 2000 ppm comprising 2% octadecyldimethylamine oxide may not require the presence of a suds suppressor. Indeed, it is an advantage of the present invention to select cleaning-effective amine oxides which are inherently much lower in foam-forming tendencies than the typical coco amine oxides. In contrast, formulations in which amine oxide is combined with a high-foaming anionic cosurfactant, e.g., alkyl ethoxy sulfate, benefit greatly from the presence of suds suppressor.

Phosphate esters have also been asserted to provide some protection of silver and silver-plated utensil surfaces; however, the instant compositions can have excellent silvercare without a phosphate ester component. Without being limited by theory, it is believed that lower pH formulations, e.g., those having pH of 9.5 and below, plus the presence of the low level amine oxide, both contribute to improved silver care.

If it is desired nonetheless to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

Enzymes other than amylase or protease (including enzyme adjuncts)—Optionally, additional enzymes can be included in the formulations herein for a wide variety of substrate cleaning purposes, including removal of colored or triglyceride-based stains. Such enzymes include lipases, cellulases, and peroxidases, as well as mixtures thereof. Other types of enzymes of any suitable origin, such as vegetable, animal, bacterial, fungal and yeast origin, may be added to further supplement the cleaning, stain-removing or anti-spotting action.

When present, lipases comprise from about 0.001 to about 0.01% of the instant compositions and are optionally combined with from about 1% to about 5% of a surfactant having limesoap-dispersing properties, such as an alkyldimethylamine N-oxide or a sulfobetaine. Suitable lipases for use herein include those of bacterial, animal and fungal origin, including those from chemically or genetically modified mutants. Suitable bacterial lipase include those produced by Pseudomonas, such as *Pseudomonas Stutzeri* ATCC 19.154 as disclosed in GB 1,372,034. Suitable lipases include those which provide a positive immunological cross-reaction with the antibody of the lipase produced from the micro-organism *Pseudomonas fluorescens* IAM 1057. This lipase and a method for its production have been described in JP 53-20487, Laid-Open Feb. 24, 1978. This lipase is available under the tradename Lipase P Amano, hereinafter "Amano-P". For additional lipase disclosures, see also U.S. Pat. No. 4,707,291, EP-B 0218272, EP-A 339,681, EP-A 385,401, and PCT/DK 88/00177.

When incorporating lipases into the instant compositions, their stability and effectiveness may in certain instances be enhanced by combining them with small amounts (e.g., less than 0.5% of the composition) of oily but non-hydrolyzing materials.

Peroxidase enzymes are also useful in the present invention. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

Enzyme Stabilizing System—The enzyme-containing compositions, especially liquid compositions, herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof.

The stabilizing system of the ADDs herein may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are widely known and readily available, and are illustrated by salts containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc., and mixtures thereof can be used if desired. In general, since the chlorine scavenger function can be performed by several of the ingredients separately listed under better recognized functions, (e.g., other components of the invention such as sodium perborate), there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any scavenger which is majorly incompatible with other ingredients, if used. For example, formulation chemists generally recognize that combinations of reducing agents such as thiosulfate with strong oxidizers such as percarbonate are not wisely made unless the reducing agent is protected from the oxidizing agent in the solid-form ADD composition. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

Chelating Agents—The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents or transition-metal selective sequestrants will generally comprise from about 0.01% to about 10%, more preferably from about 0.05% to about 1% by weight of the ADD compositions herein.

Dispersant Polymer—Preferred compositions herein may additionally contain a dispersant polymer. When present, a dispersant polymer in the instant ADD compositions is typically in the range from 0 to about 25%, preferably from about 0.5% to about 20%, more preferably from about 1% to about 8% by weight of the ADD composition. Dispersant polymers are useful for improved filming performance of the present ADD compositions, especially in higher pH embodiments, such as those in which wash pH exceeds about 9.5. Particularly preferred are polymers which inhibit the deposition of calcium carbonate or magnesium silicate on dishware.

Dispersant polymers suitable for use herein are illustrated by the film-forming polymers described in U.S. Pat. No. 4,379,080 (Murphy), issued Apr. 5, 1983, incorporated herein by reference.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1,000 to about 500,000, more preferably is from about 1,000 to about 250,000, and most preferably, especially if the ADD is for use in North American automatic dishwashing appliances, is from about 1,000 to about 5,000.

Other suitable dispersant polymers include those disclosed in U.S. Pat. No. 3,308,067 issued Mar. 7, 1967, to Diehl, incorporated herein by reference. Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Copolymers of acrylarnide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: $-[(C(R^2)C(R^1)(C(O)OR^3)]$ wherein the apparently unfilled valencies are in fact occupied by hydrogen and at least one of the substituents $R^1$, $R^2$, or $R^3$; preferably $R^1$ or $R^2$ is a 1 to 4 carbon alkyl or hydroxyalkyl group; $R^1$ or $R^2$ can be a hydrogen and $R^3$ can be a hydrogen or alkali metal salt. Most preferred is a substituted acrylic monomer wherein $R^1$ is methyl, $R^2$ is hydrogen, and $R^3$ is sodium.

The low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of about 3,500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535, both incorporated herein by reference.

Agglomerated forms of the present invention may employ aqueous solutions of polymer dispersants as liquid binders for making the agglomerate (particularly when the composition consists of a mixture of sodium citrate and sodium carbonate). Especially preferred are polyacrylates with an average molecular weight of from about 1,000 to about 10,000, and acrylate/maleate or acrylate/fumarate copolymers with an average molecular weight of from about 2,000 to about 80,000 and a ratio of acrylate to maleate or fumarate segments of from about 30:1 to about 1:2. Examples of such copolymers based on a mixture of unsaturated mono- and dicarboxylate monomers are disclosed in European Patent Application No. 66,915, published Dec. 15, 1982, incorporated herein by reference.

Other dispersant polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° C. to about 100° C., can be obtained at molecular weights of 1,450, 3,400, 4,500, 6,000, 7,400, 9,500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol. The polyethylene, polypropylene and mixed glycols are referred to using the formula: $HO(CH_2CH_2O)_m(CH_2CH(CH_3)O)_n(CH(CH_3)CH_2O)_oOH$ wherein m, n, and o are integers satisfying the molecular weight and temperature requirements given above.

Yet other dispersant polymers usefuil herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat. No. 3,803,285, Jensen, issued Apr. 9, 1974; the carboxylated starches described in U.S. Pat. No. 3,629,121, Eldib, issued Dec. 21, 1971; and the dextrin starches described in U.S. Pat. No. 4,141,841, McDanald, issued Feb. 27, 1979; all incorporated herein by reference. Preferred celulose-derived dispersant polymers are the carboxymethyl celluloses.

Yet another group of acceptable dispersants are the organic dispersant polymers, such as polyaspartate.

Corrosion Inhibitors/Anti-Tarnish Aids

The present compositions may contain one or more corrosion inhibitors or anti-tarnish aids. Such materials are preferred components of machine dishwashing compositions especially in certain European countries where the use of electroplated nickel silver and sterling silver is still comparatively common in domestic flatware, or when aluminium protection is a concern and the composition is low in silicate. When present, such protecting materials are preferably incorporated at low levels, e.g., from about 0.01% to about 5% of the ADD composition. Suitable corrosion inhibitors include paraffin oil, typically a predominantly branched aliphatic hydrocarbon having a number of carbon atoms in the range of from about 20 to about 50; preferred paraffin oil is selected from predominantly branched C 25–45 species with a ratio of cyclic to noncyclic hydrocarbons of about 32:68. A paraffin oil meeting those characteristics is sold by Wintershall, Salzbergen, Germany, under the trade name WINOG 70.

Other corrosion inhibitor compounds include benzotriazole and comparable compounds; mercaptans or thiols including thionaphtol and thioanthranol; and finely divided Aluminium fatty acid salts, such as aluminium tristearate. The formulator will recognize that such materials will generally be used judiciously and in limited quantities so as to avoid any tendency to produce spots or films on glassware or to compromise the bleaching action of the compositions. For this reason, mercaptan anti-tarnishes which are quite strongly bleach-reactive and common fatty carboxylic acids which precipitate with calcium in particular are preferably avoided.

Other Optional Adjuncts—Depending on whether a greater or lesser degree of compactness is required, filler materials can also be present in the instant ADDs. These include sucrose, sucrose esters, sodium sulfate, potassium sulfate, etc., in amounts up to about 70%, preferably from 0% to about 40% of the ADD composition. Preferred filler is sodium sulfate, especially in good grades having at most low levels of trace impurities.

Sodium sulfate used herein preferably has a purity sufficient to ensure it is non-reactive with bleach; it may also be treated with low levels of sequestrants, such as phosphonates or EDDS in magnesium-salt form. Note that preferences, in terms of purity sufficient to avoid decomposing bleach, applies also to pH-adjusting component ingredients, specifically including any silicates used herein.

Although optionally present in the instant compositions, the present invention encompasses embodiments which are substantially free from sodium chloride or potassium chloride and total chloride content may be further limited when using QSBA's or QSP's by use of alternative counter-anions to chloride, such as are illustrated by methosulfate or borate.

Hydrotrope materials such as sodium benzene sulfonate, sodium toluene sulfonate, sodium cumene sulfonate, etc., can be present in minor amounts.

Bleach-stable perfumes (stable as to odor); and bleach-stable dyes such as those disclosed in U.S. Pat. No. 4,714,562, Roselle et al, issued Dec. 22, 1987 can also be added to the present compositions in appropriate amounts. Other common detergent ingredients consistent with the spirit and scope of the present invention are not excluded.

Since ADD compositions herein can contain water-sensitive ingredients or ingredients which can co-react when brought together in an aqueous environment, it is desirable to keep the free moisture content of the ADDs at a minimum, e.g., 7% or less, preferably 4% or less of the ADD; and to provide packaging which is substantially impermeable to water and carbon dioxide. Coating measures have been described herein to illustrate a way to protect the ingredients from each other and from air and moisture. Plastic bottles, including refillable or recyclable types, as well as conventional barrier cartons or boxes are another helpful means of assuring maximum shelf-storage stability. As noted, when ingredients are not highly compatible, it may further be desirable to coat at least one such ingredient with a low-foaming nonionic surfactant for protection. There are numerous waxy materials which can readily be used to form suitable coated particles of any such otherwise incompatible components; however, the formulator prefers those materials which do not have a marked tendency to deposit or form films on dishes including those of plastic construction.

Method for Cleaning—The present invention also encompasses a method for cleaning soiled tableware comprising contacting said tableware with an aqueous medium having an initial pH in a wash solution of above about 8, more preferably from about 9.5 to about 11, most preferably from about 9.5 to about 10.5, and comprising at least about 500 ppm of a cleaning composition comprising the stability-enhanced amylases and bleach-improving material as hereinbefore defined.

Some preferred substantially chlorine bleach-free granular automatic dishwashing compositions of the invention are as follows:

A substantially chlorine-bleach free automatic dishwashing composition comprising an oxidative stability-enhanced amylase and a bleach system consisting essentially of a source of hydrogen peroxide selected from sodium perborate and sodium percarbonate; and a bleach-improving material which is a mixture of a quaternary-substituted bleach activator, a manganese or iron-containing transition metal bleach catalyst, and a diacyl peroxide;

A substantially chlorine-bleach free automatic dishwashing composition comprising an oxidative stability-enhanced amylase and a bleach system consisting essentially of a source of hydrogen peroxide selected from sodium perborate and sodium percarbonate; and a bleach-improving material which is a mixture of a manganese or iron-containing transition metal bleach catalyst and a diacyl peroxide, optionally but preferably supplemented by a nonquaternary bleach activator selected from TAED and NOBS;

A substantially chlorine-bleach free automatic dishwashing composition comprising an oxidative stability-enhanced amylase and a bleach system consisting essentially of a source of hydrogen peroxide selected from sodium perborate and sodium percarbonate; and a bleach-improving material which is a mixture of a quaternary-substituted bleach activator and a diacyl peroxide;

A substantially chlorine-bleach free automatic dishwashing composition comprising an oxidative stability-enhanced amylase and a bleach system consisting essentially of a source of hydrogen peroxide selected from sodium perborate and sodium percarbonate; and a bleach-improving material which is a mixture of a quaternary-substituted bleach activator and a manganese or iron-containing transition metal bleach catalyst;

Simple but highly effective preferred embodiments are illustrated by a substantially chlorine-bleach free automatic dishwashing composition comprising an oxidative stability-enhanced amylase and a bleach system consisting essentially of a source of hydrogen peroxide selected from sodium perborate and sodium percarbonate; and a bleach-improving material which is a quaternary-substituted bleach activator substantially free from other bleach-improving materials; or a substantially chlorine-bleach free automatic dishwashing composition comprising an oxidative stability-enhanced amylase and a bleach system consisting essentially of a source of hydrogen peroxide selected from sodium perborate and sodium percarbonate; and a bleach-improving material which is dibenzoyl peroxide; optionally but preferably supplemented by a manganese-containing transition metal bleach catalyst;

Less preferably, but still within the spirit and scope of the invention is a substantially chlorine-bleach free automatic dishwashing composition comprising an oxidative stability-enhanced amylase and a bleach system consisting essentially of a source of hydrogen peroxide selected from sodium perborate and sodium percarbonate; and a bleach-improving material which is a mixture of a manganese or iron-containing transition metal bleach catalyst, optionally but preferably supplemented by a nonquaternary bleach activator; or a substantially chlorine-bleach free automatic dishwashing composition comprising an oxidative stability-enhanced amylase and a bleach system consisting essentially of a source of hydrogen peroxide selected from sodium preborate and sodium percarbonate; and a bleach-improving material which is a mixture of a quaternary-substituted bleach activator, a diacyl peroxide and TAED, optionally supplemented by a transition-metal containing bleach catalyst.

In the above embodiments, where present, highly preferred illustrative examples of the aforementioned bleach-improving materials are as follows:

i) the organic peroxide is preferably dibenzoyl peroxide;

ii) the quaternary substituted bleach activator preferably consists essentially of one or more compounds having the following formulas: $X^-(CH_3)_3N^+(CH_2)_aC_6H_4(CH_2)_bC(O)L$ wherein L is a leaving group such as $p\text{-}OC_6H_4SO_3Na$, $X^-$ is chloride, methosulfate or an equivalent anion and a and b independently can be from 0 to about 10 and $X^-(CH_3)_3N^+(CH_2)_nC(O)L$ wherein L is a leaving group such as $p\text{-}OC_6H_4SO_3Na$, $X^-$ is chloride, methosulfate or an equivalent anion and n is from about 1 to about 12, preferably from 1 to about 8; a preferred embodiment of a compound having the former structure wherein a is 1 and b is 0 has the formula $X^-(CH_3)_3N^+(CH_2)C_6H_4C(O)L$ wherein L is a leaving group such as $p\text{-}OC_6H_4SO_3Na$, and more preferably is caprolactam or valerolactam and $X^-$ is chloride, methosulfate or an equivalent anion (See copending British application, entitled "Cationic Bleach Activators", Ser. No. 94,079,449 filed Apr. 21, 1994, P&G Case No. CM705F);

iii) the quaternary substituted peracid is the peracid corresponding to the peracid generated when compounds (ii) perhydrolyze or is absent from the automatic dishwashing composition as formulated (although it may be generated in situ during the wash when compounds (ii) perhydrolyze; and iv) the transition metal bleach catalyst is a transition metal complex, such as an iron or manganese complex, of ethylenediaminedisuccinate; or is $Mn^{IV}_2(u\text{-}O)_3$(1,4,7-trimethyl-1,4,7-triazacyclononane)$_2(PF_6)_2$.

The following examples illustrate the compositions of the present invention.

| INGREDIENT | I | II |
|---|---|---|
| Oxidative Stability Enhanced Amylase (QL37 + M197T as 3% active protein) | 0.5 | 1 |
| Sodium Perborate Monohydrate (See Note 4) | 1.5 | 1.5 |
| Sodium Percarbonate (See Note 4) | 0 | 0 |
| Dibenzoyl Peroxide | 0.1 | 0.8 |
| QSBA (See Note 2) | 2 | 2 |
| Transition Metal Bleach Catalyst (See Note 3) | 0.001 | 0 |
| Nonquaternary Bleach Activator (TAED or NOBS) | 0 | 0 |
| Protease 1 (SAVINASE 12 T, 3.6% active protein) | 2.5 | 2.5 |
| Protease 2 (Protease D, as 4% active protein) | 0 | 0 |
| Trisodium Citrate Dihydrate (anhydrous basis) | 15 | 15 |
| Sodium Carbonate, anhydrous | 20 | 20 |
| BRITESIL H2O, PQ Corp. (as SiO2) | 9 | 8 |
| Sodium Metasilicate Pentahydrate, (as SiO2) | 3 | 3 |
| Diethylenetriamine pentaacetic Acid, Sodium Salt | 0 | 0.1 |
| Diethylenetriaminepenta (methylenephosphonic acid), Sodium Salt | 0.1 | 0 |
| Hydroxyethyldiphosphonate (HEDP), Sodium Salt | 0 | 0.5 |
| Dispersant Polymer (See Note 1) | 10 | 3 |

-continued

| INGREDIENT | | |
|---|---|---|
| Nonionic Surfactant (SLF18, Olin Corp. or LF404, BASF) | 2 | 2 |
| Sodium Sulfate, water, minors | Balance to 100% | Balance to 100% |

Note 1: Dispersant Polymer: One or more of: Sokolan PA30, BASF Corp., Accusol 480N, Rohm & Haas.
Note 2: QSBA: N-[4-Triethyl-ammoniomethyl] benzoylcaprolactam chloride salt or a compound of formula $Cl(CH_3)_3N(CH_2)_5C(O)(OBSNa)$ where OBS = oxybenzenesulfonate
Note 3: Transition Metal Bleach Catalyst: MnEDDS according to U.S. application Ser. No. 08/210, 186, filed March 17, 1994 or $Mn^{IV}{}_2(u\text{-}O)_3$ $(1,4,7\text{-trimethyl-}1,4,7\text{-triazacyclononane})_2$ $(PF_6)_2$.
Note 4: These Hydrogen Peroxide Sources are expressed on an available oxygen basis. To convert to a basis of percentage of the total composition, divide by 0.15

| | III | IV | V |
|---|---|---|---|
| Oxidative Stability Enhanced Amylase (QL37 + M197T as 3% active protein) | 2 | 1.5 | 1 |
| Sodium Perborate Monohydrate (See Note 4) | 1.5 | 0 | 0 |
| Sodium Percarbonate (See Note 4) | 0 | 1.0 | 1.2 |
| Dibenzoyl Peroxide | 0 | 0.8 | 0.8 |
| QSBA (See Note 2) | 4 | 0 | 0 |
| Transition Metal Bleach Catalyst (See Note 3) | 0.07 | 0.05 | 0.05 |
| Nonquatemary Bleach Activator (TAED or NOBS) | 0 | 0 | 4 |
| Protease 1 (SAVINASE 12 T, 3.6% active protein) | 2.5 | 0 | 0 |
| Protease 2 (Protease D, as 4% active protein) | 0 | 1 | 1 |
| Trisodium Citrate Dihydrate (anhydrous basis) | 15 | 15 | 15 |
| Sodium Carbonate, anhydrous | 20 | 20 | 20 |
| BRITESIL H2O, PQ Corp. (as Si02) | 7 | 7 | 17 |
| Sodium Metasilicate Pentahydrate, (as Si02) | 3 | 0 | 0 |
| Diethylenetriamine pentaacetic Acid, Sodium Salt | 0 | 0.1 | 0 |
| Diethylenetriaminepenta (methylenephosphonic acid), Sodium Salt | 0.1 | 0 | 0.1 |
| Hydroxyethyldiphosphonate (HEDP), Sodium Salt | 0.5 | 0 | 0.5 |
| Dispersant Polymer (See Note 1) | 6 | 5 | 6 |
| Nonionic Surfactant (SLF18, Olin Corp. or LF404, BASF) | 2 | 2 | 3 |
| Sodium Sulfate, water, minors | Balance to 100% | Balance to 100% | Balance to 100% |

Note 1: Dispersant Polymer: One or more of: Sokolan PA30, BASF Corp., Accusol 480N, Rohm & Haas.
Note 2: QSBA: N-[4-Triethyl-ammoniomethyl] benzoylcaprolactam chloride salt or a compound of formula $Cl(CH_3)_3N(CH_2)_5$ $C(O)(OBSNa)$ where OBS = oxybenzenesulfonate
Note 3: Transition Metal Bleach Catalyst: MnEDDS according to U.S. application Ser. No. 08/210, 186, filed March 17, 1994 or $Mn^{IV}{}_2(u\text{-}O)_3$ $(1,4,7\text{-trimethyl-}1,4,7\text{-triazacyclononane})_2$ $(PF_6)_2$.
Note 4: These Hydrogen Peroxide Sources are expressed on an available oxygen basis. To convert to a basis of percentage of the total composition, divide by 0.15

-continued

| INGREDIENT | | | |
|---|---|---|---|
| | VI | VII | VIII |
| Oxidative Stability Enhanced Amylase (QL37 + M197T as 3% active protein) | 2 | 1.5 | 1 |
| Sodium Perborate Monohydrate (See Note 4) | 0 | 2 | 1 |
| Sodium Percarbonate (See Note 4) | 0 | 0 | 0 |
| Dibenzoyl Peroxide | 1 | 0 | 0 |
| QSBA (See Note 2) | 0 | 3 | 1 |
| Transition Metal Bleach Catalyst (See Note 3) | 0.07 | 0.01 | 0.05 |
| Nonquaternary Bleach Activator (TAED or NOBS) | 0 | 0 | 2 |
| Protease 1 (SAVINASE 12 T, 3.6% active protein) | 2.5 | 0 | 0 |
| Protease 2 (Protease D, as 4% active protein) | 0 | 1 | 1 |
| Trisodium Citrate Dihydrate (anhydrous basis) | 15 | 30 | 15 |
| Sodium Carbonate, anhydrous | 20 | 0 | 20 |
| BRITESIL H2O, PQ Corp. (as SiO2) | 7 | 10 | 8 |
| Sodium Metasilicate Pentahydrate, (as SiO2) | 3 | 0 | 1 |
| Diethylenetriamine pentaacetic Acid, Sodium Salt | 0 | 0.1 | 0 |
| Diethylenetriaminepenta (methylenephosphonic acid), Sodium Salt | 0.1 | 0 | 0.1 |
| Hydroxethyldihosphonate (HEDP), Sodium Salt | 0.1 | 0 | 0.1 |
| Dispersant Polymer (See Note 1) | 8 | 5 | 6 |
| Nonionic Surfactant (SLF18, Olin Corp. or LF404, BASF) | 1.5 | 2 | 3 |
| Sodium Sulfate, water, minors | Balance to 100% | Balance to 100% | Balance to 100% |

Note 1: Dispersant Polymer: One or more of: Sokolan PA30, BASF Corp., Accusol 480N, Rohm & Haas.
Note 2: QSBA: N-[4-Triethyl-ammoniomethyl] benzoylcaprolactam chloride salt or a compound of formula $Cl(CH_3)_3N(CH_2)_5$ $C(O)(OBSNa)$ where OBS = oxybenzenesulfonate
Note 3: Transition Metal Bleach Catalyst: MnEDDS according to U.S. application Ser. No. 08/210, 186, filed March 17, 1994 or $Mn^{IV}{}_2(u\text{-}O)_3$ $(1,4,7\text{-trimethyl-}1,4,7\text{-triazacyclononane})_2$ $(PF_6)_2$.
Note 4: These Hydrogen Peroxide Sources are expressed on an available oxygen basis. To convert to a basis of percentage of the total composition, divide by 0.15

| | IX | X | XI |
|---|---|---|---|
| Oxidative Stability Enhanced Amylase (QL37 + M197T as 3% active protein) | 5 | 1.5 | 1 |
| Sodium Perborate Monohydrate (See Note 4) | 1.5 | 2 | 0 |
| Sodium Percarbonate (See Note 4) | 0 | 0 | 2 |
| Dibenzoyl Peroxide | 0 | 0 | 0 |
| QSBA (See Note 2) | 3 | 3 | 2 |
| Transition Metal Bleach Catalyst (See Note 3) | 0.05 | 0.01 | 0.5 |
| Nonquatemary Bleach Activator (TAED or NOBS) | 0 | 0 | 0 |
| Protease 1 (SAVINASE 12 T, 3.6% active protein) | 2.5 | 0 | 0 |
| Protease 2 (Protease D, as 4% active protein) | 0 | 1 | 1 |
| Trisodium Citrate Dihydrate (anhydrous basis) | 25 | 30 | 15 |

-continued

| INGREDIENT | | | |
|---|---|---|---|
| Sodium Carbonate, anhydrous | 0 | 0 | 20 |
| BRITESIL H2O, PQ Corp. (as SiO2) | 7 | 10 | 8 |
| Sodium Metasilicate Pentahydrate, (as SiO2) | 3 | 5 | 3 |
| Diethylenetriamine pentaacetic Acid, Sodium Salt | 0 | 0 | 0 |
| Diethylenetriaminepenta (methylenephosphonic acid), Sodium Salt | 0 | 0 | 0 |
| Hydroxyethyldiphosphonate (HEDP), Sodium Salt | 0.5 | 0.2 | 0.1 |
| Ethylenediaminedisuccinate, Sodium or Magnesium Salt | 0.1 | 0.1 | 0.5 |
| Dispersant Polymer (Accusol 480N) | 8 | 5 | 6 |
| Nonionic Surfactant (LF404, BASF) | 1.5 | 2 | 3 |
| Paraffin (Winog 70) | 1 | 1 | 0.5 |
| Benzotriazole | 0.1 | 0.2 | 0.3 |
| Sodium Sulfate, water, minors | Balance to 100% | Balance to 100% | Balance to 100% |

Note 2: QSBA: N-[4-Triethyl-ammoniomethyl] benzoylcaprolactam chloride salt.
Note 3: Transition Metal Bleach Catalyst: MnEDDS according to U.S. application Ser. No. 08/210, 186, filed March 17, 1994 or $Mn^{IV}{}_2(u\text{-}O)_3$ $(1,4,7\text{-trimethyl-}1,4,7\text{-triazacyclononane})_2$ $(PF_6)_2$.
Note 4: These Hydrogen Peroxide Sources are expressed on an available oxygen basis. To convert to a basis of percentage of the total composition, divide by 0.15

| XII | |
|---|---|
| Oxidative Stability Enhanced Amylase (QL37 + M197T as 3% active protein) | 1 |
| Sodium Perborate Monohydrate (See Note 4) | 1.5 |
| Sodium Percarbonate (See Note 4) | 0 |
| Dibenzoyl Peroxide | 0 |
| QSBA (See Note 2) | 4 |
| Transition Metal Bleach Catalyst (See Note 3) | 0 |
| Nonquaternary Bleach Activator (TAED or NOBS) | 0 |
| Protease 1 (SAVINASE 12 T, 3.6% active protein) | 0 |
| Protease 2 (Protease D, as 4% active protein) | 1 |
| Trisodium Citrate Dihydrate (anhydrous basis) | 15 |
| Sodium Carbonate, anhydrous | 20 |
| BRITESIL H2O, PQ Corp. (as SiO2) | 8 |
| Sodium Metasilicate Pentahydrate, (as SiO2) | 1 |
| Diethylenetriamine pentaacetic Acid, Sodium Salt | 0 |
| Diethylenetriaminepenta(methylene-phosphonic acid), Sodium Salt | 0 |
| Hydroxyethyldiphosphonate (HEDP), Sodium Salt | 0.1 |
| Dispersant Polymer (See Note 1) | 6 |
| Nonionic Surfactant (SLF18, Olin Corp. or LF404, BASF) | 3 |
| Sodium Sulfate, water, minors | Balance to 100% |

Note 1: Dispersant Polymer: One or more of: Sokolan PA30, BASF Corp., Accusol 480N, Rohm & Haas.
Note 2: QSBA: N-[4-Triethyl-ammoniomethyl] benzoylcaprolactam chloride salt or a compound of formula $Cl(CH_3)_3N(CH_2)_5C(O)(OBSNa)$ where OBS = oxybenzenesulfonate
Note 3: Transition Metal Bleach Catalyst: MnEDDS according to U.S. application Ser. No. 08/210, 186, filed March 17, 1994 or $Mn^{IV}{}_2(u\text{-}O)_3$ $(1,4,7\text{-trimethyl-}1,4,7\text{-triazacyclononane})_2$ $(PF_6)_2$.
Note 4: These Hydrogen Peroxide Sources are expressed on an available oxygen basis. To convert to a basis of percentage of the total composition, divide by 0.15

| XIII | |
|---|---|
| Oxidative Stability Enhanced Amylase (QL37 + M197T as 3% active protein) | 2 |
| Sodium Perborate Monohydrate (See Note 4) | 1.5 |
| Sodium Percarbonate (See Note 4) | 0 |
| Dibenzoyl Peroxide | 0 |
| QSBA (See Note 2) | 3 |
| Transition Metal Bleach Catalyst (See Note 3) | 0.05 |
| Nonquaternary Bleach Activator (TAED or NOBS) | 0 |
| Protease 1 (SAVINASE 12 T, 3.6% active protein) | 2.5 |
| Protease 2 (Protease D, as 4% active protein) | 0 |
| Trisodium Citrate Dihydrate (anhydrous basis) | 25 |
| Sodium Carbonate, anhydrous | 0 |
| BRITESIL H2O, PQ Corp. (as SiO2) | 7 |
| Sodium Metasilicate Pentahydrate, (as SiO2) | 3 |
| Diethylenetriamine pentaacetic Acid, Sodium Salt | 0 |
| Diethylenetriaminepenta(methylene-phosphonic acid), Sodium Salt | 0 |
| Hydroxyethyldiphosphonate (HEDP), Sodium Salt | 0 |
| Ethylenediaminedisuccinate, Sodium or Magnesium Salt | 0.1 |
| Dispersant Polymer (Accusol 480N) | 8 |
| Nonionic Surfactant (LF404, BASF) | 1.5 |
| Paraffin (Winog 70) | 1 |
| Benzotriazole | 0.1 |
| Sodium Sulfate, water, minors | Balance to 100% |

Note 2: QSBA: N-[4-Triethyl-ammoniomethyl] benzoylcaprolactam chloride salt.
Note 3: Transition Metal Bleach Catalyst: MnEDDS according to U.S. application Ser. No. 08/210, 186, filed March 17, 1994 or $Mn^{IV}{}_2(u\text{-}O)_3$ $(1,4,7\text{-trimethyl-}1,4,7\text{-triazacyclononane})_2$ $(PF_6)_2$.
Note 4: These Hydrogen Peroxide Sources are expressed on an available oxygen basis. To convert to a basis of percentage of the total composition, divide by 0.15

The compositions of the above examples are used to wash tea-stained cups, starch-soiled and spaghetti-soiled dishes, mnilk-soiled glasses, starch, cheese, egg or babyfood-soiled flatware, and tomato-stained plastic spatulas by loading the soiled dishes in a domestic automatic dishwashing appliance and washing using either cold fill, 60° C. peak, or uniformly 45–50° C. wash cycles with a product concentration of the exemplary compositions of from about 1,000 to about 5,000 ppm, with excellent results.

Additional compositions, in particular, comprising 0.8% as AvO of sodium perborate, 2% QSBA, 2% oxidatively stable amylase, 1% protease D, and 10% of ethoxylated nonionic surfactant are used to wash textile fabrics with excellent results.

EXAMPLES XIV–XXIII

The quaternary substituted bleach activator (QSBA) of Examples I–III and VII–XIII is substituted by an equivalent amount of a QSP of formula $\{(CH_3)_3N^+CH_2C(OOH)\}$ $\{HSO_3^-\}$ according to U.S. Pat. No. 5,245,075, of Sep. 14, 1993. See especially compound of Example 3.

EXAMPLES XXIV–XXXIII

The quaternary substituted bleach activator (QSBA) of the above Examples I–III and VII–XIII is substituted by an equivalent amount of an alternate QSBA of formula $\{(C_8H_{17})(CH_3)_2N^+(CH_2)_3C(O)(OC_6H_5)\}$ $\{Cl^-\}$ according to U.S Pat. No. 4,397,757, of Aug. 9, 1983. See especially Table 1 and preparation methods 1 and 2.

EXAMPLES XXXIV–XLIII

The quaternary substituted bleach activator (QSBA) of the above Examples I–III and VII–XIII is substituted by an equivalent amount of an alternate QSBA of formula $\{(C_8H_{17})(CH_3)_2N^+(CH_2)_3C\ (O)(OC_6H_4SO_3^-)\}$ $\{Cl^-\}$ according to E.P. 284,292, Aoygi et al., published Sept. 28, 1988. See especially example 1, pages 15–16 of the specifications.

In the above examples, the QSBA can be substituted with 0.5% of formula of Peroxidase enzyme, according to PCT WO 89/099813.

What is claimed is:

1. An automatic dishwashing detergent composition which comprises by weight:

(A) from about 0.5% to about 5% by weight of the composition of an oxidative stability enhanced amylase enzyme wherein said oxidative stability enhanced is enhanced from substitution using threonine or alanine of the methionine residue in position 197 of bacillus licheniformis or the homologous position in an amylase enzyme derived from bacillus subtilis, bacillus amyloliquefaciens, or bacillus stearothermophilis;

(B) from about 1.0% to about 5%, on an available oxygen basis, of hydrogen peroxide sources selected from the group conlsisting of percarbonate, perborate, and mixtures thereof;

(C) from about 0.1% to about 10% of bleach improving materials selected from the group consisting of a bleach activator with the formula $X^-C(H_3)_3N(CH_2)_nC(O)L$ where n is an integer from 1 to 12, X is an anion, and L is a leaving group conisistii, of caprolactan and valerolactam;

(D) a protease enzyme in an amount which provides 0.005% to 0.1% Anson units of activity per gram of composition.

2. An automatic dishwashing composition according to claim 1 further comprising from about 0.1% to about 10% of a low foaming surfactant.

3. An automatic dishwashing composition according to claim 2 further comprising from about 1% to about 50%, by weight of composition, of pH adjusting component; wherein said pH adjusting component provides a wash solution pH of at least about 8.

4. A cleaning composition according to claim 1 in the form of a liquid or granular textile cleaning composition additionally comprising a chelating effective amount of a transition metal chelant.

5. A cleaning composition according to claim 1 additionally comprising a enzymatic effective amount of peroxidase enzyme.

6. A method for cleaning soiled tableware comprising contacting said tableware with a pH wash aqueous medium of at least 8 and comprising at least about 500 ppm of a composition according to claim 1.

7. A method according to claim 6 wherein said wash solution pH is from about 9.5 to about 11.

* * * * *